US007576445B2

(12) United States Patent
Hammerschmidt

(10) Patent No.: US 7,576,445 B2
(45) Date of Patent: Aug. 18, 2009

(54) POWER SUPPLY ARRANGEMENT FOR PROVIDING AN OUTPUT SIGNAL WITH A PREDETERMINED OUTPUT SIGNAL LEVEL

(75) Inventor: Dirk Hammerschmidt, Villach (AT)

(73) Assignee: Infineon Technologies AG, Munich (DE)

( * ) Notice: Subject to any disclaimer, the term of this patent is extended or adjusted under 35 U.S.C. 154(b) by 45 days.

(21) Appl. No.: 11/615,061

(22) Filed: Dec. 22, 2006

(65) Prior Publication Data

US 2007/0164547 A1 Jul. 19, 2007

(30) Foreign Application Priority Data

Dec. 23, 2005 (DE) ..... 10 2005 061 967

(51) Int. Cl.
*B60L 1/00* (2006.01)
*B60L 3/00* (2006.01)
*H02G 3/00* (2006.01)

(52) U.S. Cl. ..... 307/10.1; 180/282; 280/728.1; 280/735

(58) Field of Classification Search ..... 307/10.1; 180/271, 282; 280/728.2, 735, 278.1
See application file for complete search history.

(56) References Cited

U.S. PATENT DOCUMENTS 5,025,203 A 6/1991 Edwards ..... 323/268
5,995,891 A * 11/1999 Mayumi et al. ..... 701/45
7,142,407 B2 * 11/2006 Sibrai ..... 361/247

FOREIGN PATENT DOCUMENTS

EP 0501418 A2 9/1992

* cited by examiner

*Primary Examiner*—Albert W Paladini
*Assistant Examiner*—Carlos Amaya
(74) *Attorney, Agent, or Firm*—Eschweiler & Associates, LLC

(57) ABSTRACT

A power supply arrangement has a charge storage means, a charge means, a reference signal source and a processing means. The power supply arrangement is implemented to provide the output signal with the predetermined output signal level at the output terminal based on the supplementary supply signal or based on a combination of the supplementary supply signal and the input signal, if the actual input signal level is lower in amount to the set input signal level. The power supply arrangement can be used in a side airbag sensor system, wherein a power supply and communication protocol is used, which transmits an input signal in the form of a transmitted pulse to a sensor via the voltage supply, to store energy based on the transmitted pulse and to use the same to maintain an output level at the output of the voltage supply, when the input voltage falls below a critical threshold.

33 Claims, 5 Drawing Sheets

POWER SUPPLY ARRANGEMENT FOR PROVIDING AN OUTPUT SIGNAL WITH A PREDETERMINED OUTPUT SIGNAL LEVEL

RELATED APPLICATIONS

This application claims priority from German Patent Application No. DE 10 2005 061 967.3, which was filed on Dec. 23, 2005 and is incorporated herein by reference in its entirety.

TECHNICAL FIELD

The present invention relates to a power supply arrangement for providing an output signal with a predetermined output signal level, and particularly to a power supply arrangement, which is supplied with an input signal having a first input signal level and a second input signal level with a higher amount, and which provides the output signal with the predetermined output signal level, wherein the output signal of such a power supply arrangement can particularly be supplied to a downstream sensor arrangement in a vehicle as power supply signal or supply voltage, respectively.

BACKGROUND

More and more, sensors are used in vehicles for detecting environmental amounts, environmental influences, etc., wherein the number of sensors in a vehicle increases continuously, particularly for security-relevant systems. The used sensors serve, for example, for determining ambient pressure, acceleration, revolutions per minute or relative distance or relative movements, respectively, such as the distance to an object close to the vehicle.

Here, the sensors communicate with central control units in a vehicle, such as an on-board computer or an associated electronic control unit ECU, via the usual sensor supply networks in vehicles. The control units evaluate the sensor data received via the sensor supply network and then cause actuation, switching-on or powering-on of a security system in a vehicle. These security systems can comprise, for example, ABS (ABS=anti-blocking system), traction control, airbag system, distance control or other sensor systems. In vehicles, sensor supply networks are normally realized as two-wire connections.

One of the most important and also most widespread security systems are airbag systems. An airbag system, for example with steering wheel airbag, passenger airbag, side airbag, etc. consists thereby mainly of one or several airbag sensors, associated electronic control unit, a trigger arrangement with trigger circuit and the airbag itself.

A sensor that can detect pressure or acceleration, such as a side airbag sensor, is, for example, in a door of the vehicle or at a supporting column of the vehicle and is connected to the electronic control unit via cable and plug connectors. The electronic control unit receives a signal from the side airbag sensor via the sensor supply network, evaluates the same and decides about triggering the airbag. The voltage supply of airbag sensors is also performed via the sensor supply network of the vehicle. Thereby, voltage variations, such as short-term setbacks of the supply voltage, can occur in the sensor supply networks of vehicles and particularly in certain areas of the sensor supply network. For example, heavy jerky movements, such as shocks or vibrations of the vehicle can cause short-term interruptions at one of the plug connections, so that short-term setbacks of the voltage supply of security-relevant systems, such as the side airbag sensor, can also occur. These setbacks of the voltage supply are generally referred to as microbreaks.

For that reason, an effort is made to implement the security-relevant systems in vehicles such that they are as insensitive as possible against such setbacks of the supply voltage, so that an operation of the security-relevant systems, which is as stable as possible, can be maintained, even when such setbacks or breaks of the voltage supply occur.

When microbreaks occur, it can be observed that unfavorably side airbag sensors can be reset unintentionally by such interruptions of the supply voltage, wherein such an unintentional reset (power on reset) would have the effect that the side airbag sensor would run through a complete initialization for a longer time period. Such an initialization includes, among others, a long or extensive start message transmission defined in a protocol. During the transmission of the start message, triggering of the airbag is not possible, since the airbag sensor runs through its initialization in this phase, and can thus provide no measurement data, which would allow the electronic control unit to detect a release event, such as an accident.

Thus, in order to increase the operational safety of a vehicle, it is necessary that the airbag sensor remains operable during such microbreaks, i.e. during short-term setbacks of the supply voltage, for a time period that is as long as possible, or remains uninfluenced by such microbreaks, respectively, so that the whole airbag system is not put out of operation or reset by these microbreaks, respectively.

So far, this increase of operational safety is realized by carrying out the voltage supply from an additional spare voltage source with a battery or a buffer capacitor connected in parallel on the input side.

Frequently, so-called buffer capacitors are used as spare voltage sources, which are to stabilize the operating voltage of the sensor and to maintain the voltage supply of the sensor, while the connection between the electronic control unit and the side airbag sensor is interrupted. Such buffer capacitors are connected on the input side to the supply voltage terminal of the side airbag sensor and are thereby charged to the current operating voltage, i.e. the operating voltage currently applied to the sensor. When the difference between the specified bottom limit of the operating voltage and the reset threshold (reset threshold) is low, the buffer capacitor is only charged to a voltage level, which is slightly above the reset threshold, when the operating voltage is already close to the bottom limit. When the supply voltage is set back to a value lying below the reset threshold, the voltage supply can be maintained by energy stored in the buffer capacitor, whereby a buffer capacitor can provide only relatively little energy for shunting the microbreak in the above illustrated case.

In that context, it should be considered that only relatively little of the stored energy or charge, respectively, can be drawn from a buffer capacitor, or the buffer capacitor can only be discharged across a relatively low time period, until a reset is triggered at the sensor, since the difference between the two voltage states, namely the lower operating voltage limit and the reset threshold is relatively low. Thus, the difference between the two charge states of the buffer capacitor, namely the charge state and the lower operating voltage limit and the charge state at the resent threshold is relatively low. Thus, reliable voltage supply of side airbag sensors is often not possible when variations of the operating voltage (microbreaks) occur.

A further conventional procedure for supplying electronic circuits during a microbreak of the supply voltage as stable as possible with energy, is to use a so-called battery backup switch. Here, a supply voltage terminal of the side airbag sensor is connected to the electronic control unit via the battery backup switch, wherein the battery backup switch switches to a backup battery connected to the battery backup switch, when the input voltage provided by the electronic control unit or the sensor supply network breaks down. The battery backup switch switches between the supply voltage provided by the electronic control unit and the battery voltage, such that the voltage source, i.e. the sensor supply network or the backup battery with the higher voltage provides the current supply voltage to the side airbag sensor. Such battery backup switches are sold for example, by the company "Analog Devices" with the type designation "ADM 690".

It is a disadvantage of the usage of a battery backup switch that the used batteries only have a relatively limited life span, and thus have to be replaced after a certain time period, such that a power supply system with backup battery is expensive to implement and thus relatively expensive. Above that, it should be considered that batteries themselves are relatively sensitive to external environmental influences and particularly with regard to the ambient temperature, wherein batteries frequently loose the utilizability very fast with very low temperatures. Thus, the reliability of security-relevant sensor systems using battery backup switches is also limited. For that reason, generally, the usage of battery backup switches for security-relevant sensor systems in vehicles is avoided.

Thus, the conventional power supply arrangements have shown to be problematic in allowing a reliable provision of a stable, predetermined output signal with a predetermined output signal level with undesired vibrations of the input signal level in an efficient way, particularly when the input signal level falls below a critical threshold, based on energy stored in a buffer capacitor or another additional backup battery.

SUMMARY

According to an embodiment a power supply arrangement with an input terminal for receiving an input signal with an actual input signal level and an output terminal for providing an output signal with a predetermined output signal level, may have: a charge storage means, which is implemented to store electrical energy, and to provide a supplementary supply signal with a supplementary supply signal level; a charge means, which is implemented to receive the input signal, wherein the input signal assumes a first input signal level and a second input signal level successively in time, wherein the second input signal level is higher in amount than the first input signal level, and which is further implemented to charge the charge storage means to the supplementary supply signal level, when the input signal level is on a higher level in amount than the supplementary supply signal level; a reference signal source, which is implemented to provide a reference signal having information about a set input signal level; and a processing means, which is formed to provide the output signal with the predetermined output signal level at the output terminal, based on the supplementary supply signal or based on a combination of the supplementary supply signal and the input signal, if the actual input signal level is lower in amount than the set input signal level.

BRIEF DESCRIPTION OF THE DRAWINGS

These and other objects and features of the present invention will become clear from the following description taken in conjunction with the accompanying drawings, in which.

DETAILED DESCRIPTION

Figure 1A:
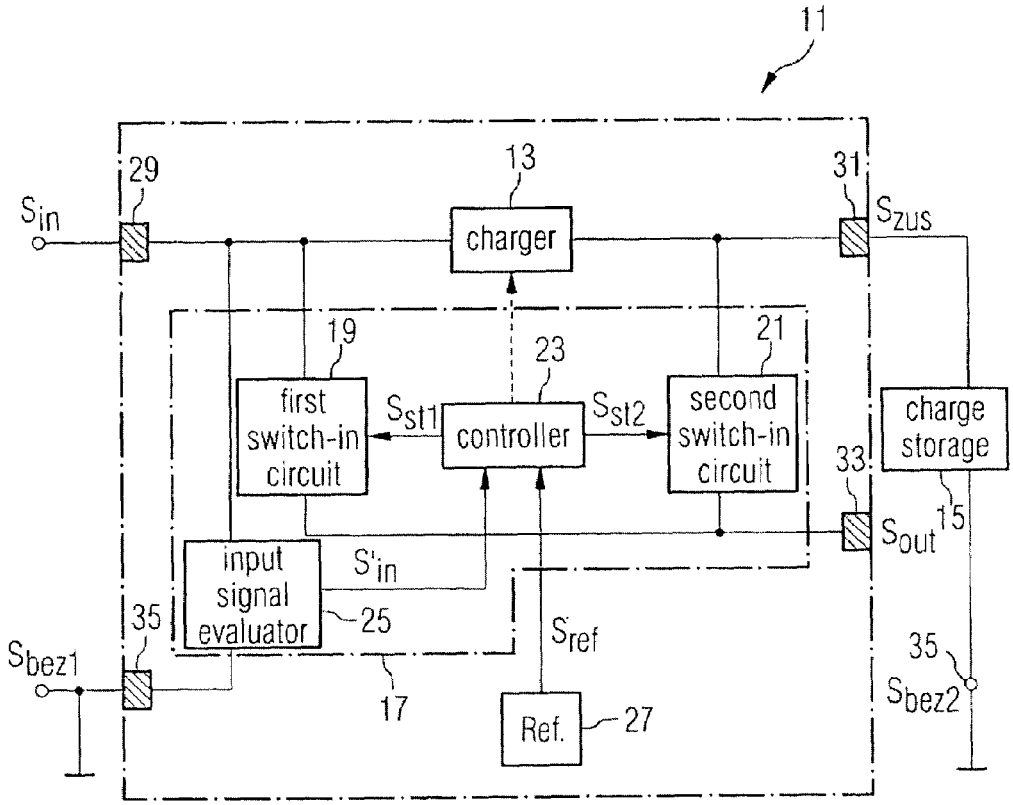
FIGS. 1*a-b* are a schematic illustration for explaining the mode of operation of a power supply arrangement according to a first embodiment with a possible technical realization of the power supply arrangement according to the first embodiment.

According to another embodiment a side airbag sensor system may have the above-mentioned power supply arrangement.

The embodiments described in this application are based on the knowledge that a power supply arrangement in a system, such as a sensor system and particularly a side airbag sensor system, where a power supply and communication protocol is used, which transmits an input signal in the form of a transmitted pulse to a sensor via the voltage supply, comprises a charge storage means for storing energy based on a transmitted pulse, and to use it then to maintain an output level at the output of the voltage supply, when the input voltage (e.g. the voltage of the sensor supply network) falls below a critical threshold.

According to an embodiment, a first level of the input signal corresponds to a normal input or operating voltage of the power supply arrangement, while a second level of the input signal, which has an higher amount than the first input signal level, is, for example, used to transmit a synchronization pulse to the sensor, such as the side airbag sensor.

The energy of the pulse to be transmitted can be used to charge a charge storage means such that an additional switchable additional voltage supply is set, which has a higher level than the first input signal level of the input signal and thus than the operating voltage.

According to an embodiment, the energy stored in the charge storage means can be used as supplementary supply signal, when the level at the input voltage supply of the power supply arrangement falls below a predetermined or critical threshold, respectively, in order to allow the power supply arrangement to further provide the output signal with a predetermined level. Here, particularly in the power supply arrangement, switching can be preformed either from the operating voltage (input voltage) to the supplementary supply voltage, or the supplementary supply voltage can be switched into the input voltage such that part of the output signal is fed from the energy of the supplementary supply and the residual part of the output signal is fed from the input voltage.

According to an embodiment, below the critical threshold means a level of the input signal, i.e. the operating voltage, when the same is exceeded, the power supply arrangement can provide the output signal with the predetermined level at its output terminal exclusively based on the input signal or the energy of the input signal, respectively, and when the same is undershot, the power supply arrangement can provide the output signal not only based on the provided input signal, but the supplementary supply energy has to be switched in at least partly. If the level of the input voltage has a lower amount than the threshold, for example due to a microbreak, the power supply arrangement is no longer able to provide the output signal with the predetermined output signal level merely based on the reduced input signal, while when the level of the input voltage is higher than the predetermined threshold, the power supply arrangement can provide the output signal with the predetermined output signal level merely based on the input signal.

According to an embodiment, predetermined output signal means a minimum level or level range of the output signal, which the power supply arrangement should provide at its output terminal to be able to maintain a supply or an operation of a downstream circuitry or load circuit, respectively, such as a sensor and particularly a side airbag sensor, in an unaffected way.

Since according to an embodiment, the signal level of the supplementary supply signal is higher than the first input signal level, this level of the backup energy that can be switched in is higher than in conventional power supply arrangements with buffer capacitors, where the stored level of the buffer capacitor corresponds to the level of the operating voltage.

Further, according to an embodiment, it should be considered that specific discharge of the charge storage means is preferably exclusively possible when the input signal has a level, which is lower in amount than the set input signal level. Since according to an embodiment, the charge storage means of the power supply arrangement is charged to a higher level than the common operating voltage, and can be discharged specifically, the power supply arrangement can use the charge storage means in a more efficient way to provide an output signal with a predetermined output signal level at the output of the power supply arrangement, than would be possible with conventional power supply arrangements with buffer capacitors or battery backup switches.

According to an embodiment, the additional supply voltage provided by the charge storage means has a higher level than the first input signal level, the output signal of the power supply arrangement can be provided across a longer time period with the predetermined output signal level when the input signal level is lower than the set input signal level, than is the case with conventional power supply arrangements with buffer capacitors. Thus, at the same time, the stability of the output signal of the power supply arrangement is increased, even when microbreaks are present in the input signal.

A particular advantage is the usage of the power supply arrangement in a side airbag system, which is supplied with an input signal at an input, which has short periodic pulses and particularly synchronization pulses with increased input signal level. Then, the side airbag sensor requires no input-side buffer capacitor at its supply voltage terminal to stabilize the voltage supply for the case that the input voltage falls below its critical input voltage threshold.

If the power supply arrangement is implemented as integrated circuitry, the charge storage apparatus, such as a capacitor, can be arranged external or also internal of the power supply arrangement arranged on a semiconductor circuit chip, since the required capacitance value for the charge storage means of the supply voltage arrangement can be implemented relatively low.

Below, with reference to FIG. 1, the basic mode of operation of a power supply arrangement 11 according to a first embodiment will be discussed exemplarily.

The power supply arrangement 11 according to the first embodiment comprises a charge means 13, a charge storage means 15, a processing means 17 with an input signal switch-in means 19, a supply signal switch-in means 21, a switch-in control means 23 and an input signal evaluation means 25, and further a reference signal source 27. Above that, the power supply arrangement 11 has an input signal terminal 29, a supply signal terminal 31, an output terminal 33 and a reference potential terminal 35, which is normally implemented as common ground terminal, and will be referred to as ground terminal 35 below. As can be seen from FIG. 1*a*, the power supply arrangement can be referenced to different reference potentials $S_{bez1}$, $S_{bez2}$, wherein in the following description one reference potential, namely ground potential, is assumed.

An input signal $S_{in}$ is applied to the input signal terminal 29, which serves as operating input voltage in the power supply arrangement 11, wherein a predetermined preferably regulated output signal $S_{out}$ is provided at the output signal terminal 33, while an additional supply signal $S_{zus}$, which will be designated below as supplementary supply signal $S_{zus}$ is applied to the supply signal terminal 31. The output signal $S_{out}$ of the power supply arrangement can be in a particularly advantageous way provided to a downstream sensor arrangement as power supply signal or as supply voltage, respectively, in a vehicle.

The charge means 13 is connected between the input signal terminal 29 and the supplementary supply signal terminal 31 with an optional current-limiting resistor 53. The charge storage means 15, preferably a capacitor, is switched between the supplementary supply signal terminal 31 and the ground terminal 35. The input signal terminal 29 is connected to the input signal evaluation means 25. Corresponding to the implementation of the input signal evaluation means 25, which will be discussed in detail below with reference to FIG. 1*b*, the same can optionally be referenced to the ground potential 35.

The input signal switch-in means 19 is connected between the input signal terminal 29 and the output signal terminal 33, while the supply signal switch-in means 19 is connected between the supply signal terminal 31 and the output signal terminal 33.

The input signal evaluation means 25 provides an evaluation signal $S'_{in}$ derived from the input signal $S_{in}$ to the switch-in control means 23. The derived input signal $S'_{in}$ has information with regard to the input signal level of the input signal $S_{in}$ at the input signal terminal 29. The switch-in control means 23 controls the input signal switch-in means 19 via a first control signal $S_{st1}$ and the supply signal switch-in means 21 via a second control signal $S_{st2}$, i.e. the switch-in control means 23 "regulates", which portion of the input signal $S_{in}$ and which portion of the supplementary supply portion $S_{zus}$ contributes to the output signal $S_{out}$ provided at the output terminal 33.

Figure 2:
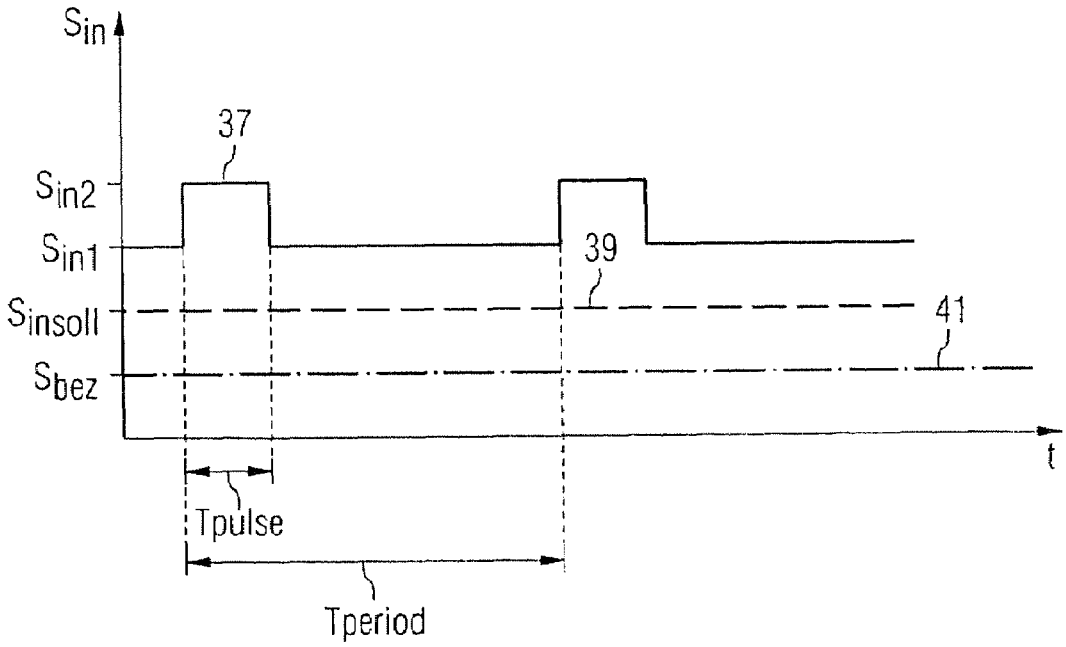
FIG. 2 is an exemplary temporal waveform of an input signal of the power supply arrangement.

The detailed description of the mode of operation follows below with reference to the exemplary waveform of the supplied input signal $S_{in}$ illustrated in FIG. 2, which corresponds, for example, to a proprietary supply protocol of side airbag sensors. In the illustration of FIG. 2, the waveform of the input signal $S_{in}$ has no so-called microbreaks.

As can be seen from FIG. 2 with regard to the waveform of the input signal $S_{in}$, a time axis t is plotted on the x-axis in FIG. 2, while an amount level of the input signal $S_{in}$ is plotted on the y-axis. Since a signal level of an input signal $S_{in}$ can (theoretically) have a positive or negative sign with regard to the reference potential, according to an embodiment, amount ratios are assumed with relative indications with regard to the height of the signal level.

The waveform 37 of FIG. 2, which is illustrated with a continuous line, represents a curve of the input signal $S_{in}$ over time t, while the curve 39 illustrated by a dotted line represents exemplarily an allowable (lower) threshold $S_{in\text{-}soll}$ of the input signal $S_{in}$. The dotted line 41 is to represent a value of the reference potential $S_{bez}$, preferably ground potential.

The input signal $S_{in}$ assumes a first input signal level $S_{in1}$, where no pulse is overlaying the input signal $S_{in}$, and assumes a second input signal level $S_{in2}$, during a time period $T_{pulse}$ of a pulse. Thereby, the input signal $S_{in}$ increases in amount in a periodic sequence with a period duration $T_{period}$ from the first input signal level $S_{in1}$ to the second input signal level $S_{in2}$ and drops again to the first input signal level $S_{in}$ after the time period (pulse time period $T_{pulse}$). The second input signal level $S_{in2}$ is higher in amount than the first input signal level $S_{in1}$. Thereby, the level of the input signal $S_{in}$ is related to the reference potential $S_{bez}$ at the reference potential terminal 35.

The (allowable) threshold $S_{in\text{-}soll}$ is thereby defined as follows: When the level of the input signal $S_{in}$ is lower in amount than the allowable threshold $S_{in\text{-}soll}$ of the input signal $S_{in}$, the power supply arrangement 11 can no longer provide the output signal $S_{out}$ with the predetermined output signal level exclusively by using the input signal $S_{in}$. When the level of the input signal $S_{in}$ is higher in amount than the allowable threshold $S_{in\text{-}soll}$, the power supply arrangement 11 can supply the output signal $S_{out}$ with the predetermined output signal level by using the input signal $S_{in}$.

According to an embodiment, it should be noted that the predetermined output signal $S_{out}$ is "predetermined" in that the predetermined output signal $S_{out}$ either exceeds a predetermined minimum output signal level $S_{out\text{-}soll}$ or lies in a predetermined range for the signal level of the output signal $S_{out}$, i.e. for example between two predetermined limits or within a predetermined tolerance range around a predetermined value for the output signal.

According to the power supply arrangement 11, a downstream circuitry to be supplied, such as a side airbag sensor, can ensure perfect operation when only one output signal $S_{out}$ with such a predetermined output signal level is provided. Typical and preferred values or ranges of values for the first signal level of the input signal are in amount, for example, in a range of 2V to 40V and preferably between 5V and 18V. Typical and preferred values or ranges of values for the second signal level of the input signal are in amount, for example, in a range of 5V to 50V and preferably between 9V and 24V. According to an embodiment, it should further be considered that the amount of the second signal level should lie more than 1V and preferably more than 3V above the first signal level.

The pulse width $T_{pulse}$ of the synchronization pulse, i.e. the second input signal level, lies, for example, in a range of 10 μs to 300 μs and preferably between 30 μs and 80 μs, wherein the period duration $T_{period}$ lies, for example, in a range of 50 μs to 1500 μs and preferably in a range of 230 μs to 600 μs.

The above ranges of values are often based on the protocols, which are, for example, used for side airbag sensors, to transmit signals from the sensor arrangement to an electronic control unit (ECU).

Below, the mode of operation of the power supply arrangement 11 illustrated in FIG. 1*a* will be discussed according to a first embodiment by using the waveforms of FIG. 2.

The input signal evaluation means 25 provides an input signal evaluation signal $S'_{in}$ to the switch-in control means 23, which is derived from the level of the input signal $S_{in}$, wherein the derived input signal $S'_{in}$ has information about the current level of the input signal $S_{in}$. The reference signal source 27 provides the reference signal $S_{ref}$, which has information about a value of a minimum input signal threshold or the allowable threshold $S_{in\text{-}soll}$ of the input signal $S_{in}$, to the switch-in control means 23.

As the following discussion will show, the input signal evaluation means can be implemented, for example, as voltage divider. The reference signal source 27 can have, for example, a so-called bandgap circuit.

Now, the charge means 13 charges the charge storage means 15 in dependence on the level of the input signal $S_{in}$, i.e. for example when the level of the input signal $S_{in}$ is higher than the level of the additional supply voltage $S_{zus}$. Particularly, the charge storage means 15 is charged during the impulses with the second input signal level $S_{in2}$ of the input signal. According to an embodiment, the switch-in control means 23 of the power supply arrangement 11 evaluates the reference signal $S_{ref}$ and the derived input signal $S'_{in}$ according to whether the level of the input signal $S_{in}$, has fallen below the allowable threshold $S_{in\text{-}soll}$, and controls then the input signal switch-in means 29 and the supply signal switch-in means 31 via the first and second control signal $S_{st1}$, $S_{st2}$ such that the output signal $S_{out}$ has the predetermined output signal level.

There are mainly two preferred possibilities according to an embodiment, according to which the switch-in control means 23 controls the input signal switch-in means 19 and the supply signal switch-in means 21 via the first and second control signal $S_{st1}$, $S_{st2}$, for switching-in the input signal $S_{in}$ and/or the additional supply signal $S_{zus}$ to the output signal terminal 33 such that the output signal $S_{out}$ has the predetermined level.

A first option is that the input signal switch-in means 19 and the supply signal switch-in means 31 each have a switch means, wherein the switch means is connected between the input terminal 29 and the output terminal 33 in the input signal switch-in means 19, and a switch means is connected between the supply voltage signal terminal 31 and the output signal terminal 31 in the supply signal switch-in means 21. According to the first option, the switch-in control means 33 can switch between a first signal path from the input signal terminal 29 to the output signal terminal 33, and a second signal path from the supply signal terminal 31 to the output signal terminal 33.

With regard to the power supply arrangement 11, this means that the switch-in control means 23 controls the input signal switch-in means 19 or the switch means arranged therein, respectively, and the supply signal switch-in means 21 or the switch means arranged therein, respectively, such that the input signal $S_{in}$ is supplied to the output signal terminal 33 by the first signal path, when the level of the input signal $S_{in}$ is higher in amount than the allowable threshold value $S_{in\text{-}soll}$, so that the output signal $S_{out}$ is provided according to the first possibility exclusively from the input signal $S_{in}$.

When the level of the input signal $S_{in}$ falls below the allowable threshold value $S_{in\text{-}soll}$, the switch-in control means 23 detects this condition from an evaluation of the reference signal $S_{ref}$ with the derived input signal $S'_{in}$. Then, the switch-in control means 22 opens the switch means in the input signal switch-in means 19 and closes the switch means in the supply signal switch-in means 21. Thus, the first signal path between the input signal terminal 29 and the output signal terminal 33 is interrupted, while the second signal path between the supply signal terminal 31 and the output signal terminal 33 is continuous. In this situation, i.e. when the input signal $S_{in}$ lies below the threshold value $S_{in\text{-}soll}$, the output signal $S_{out}$ at the output terminal 33 can be fed for example exclusively from the supplementary supply signal $S_{zus}$ provided by the charge storage means 15.

A further possible implementation of the charge supply arrangement 11 could be that the input signal switch-in means 19, the supply signal switch-in means 21 and the switch-in control means 23 are implemented such that the switch-in control means 23 can cross-fade continuously between the first and second signal path by the input signal switch-in means 19 and the supply signal switch-in means 21, wherein, for example, the signal portion of the input signal $S_{in}$ and the supplementary supply signal $S_{zus}$ at the output signal $S_{out}$ can be changed continuously or in a predetermined ratio, i.e. for example in dependence on difference between the level of the input signal $S_{in}$ and the allowable threshold $S_{in\text{-}soll}$.

Thereby, the switch-in control means 23 can evaluate the derived input signal $S'_{in}$ based on the reference signal $S_{ref}$, and can then continuously reset the portion of the input signal $S_{in}$ and the supply signal $S_{zus}$ of the output signal $S_{out}$, wherein the portion of the input signal $S_{in}$ of the provided output signal $S_{out}$ is reduced, and the corresponding portion of the additional supply signal $S_{zus}$ can be increased, the further the level of the input signal $S_{in}$ sinks below the threshold $S_{in\text{-}soll}$. Thus, according to an embodiment, the level of the output signal $S_{out}$ can be reset such that the same has the predetermined output signal level, wherein still the input signal $S_{in}$ is used as far as possible.

Figure 1B:
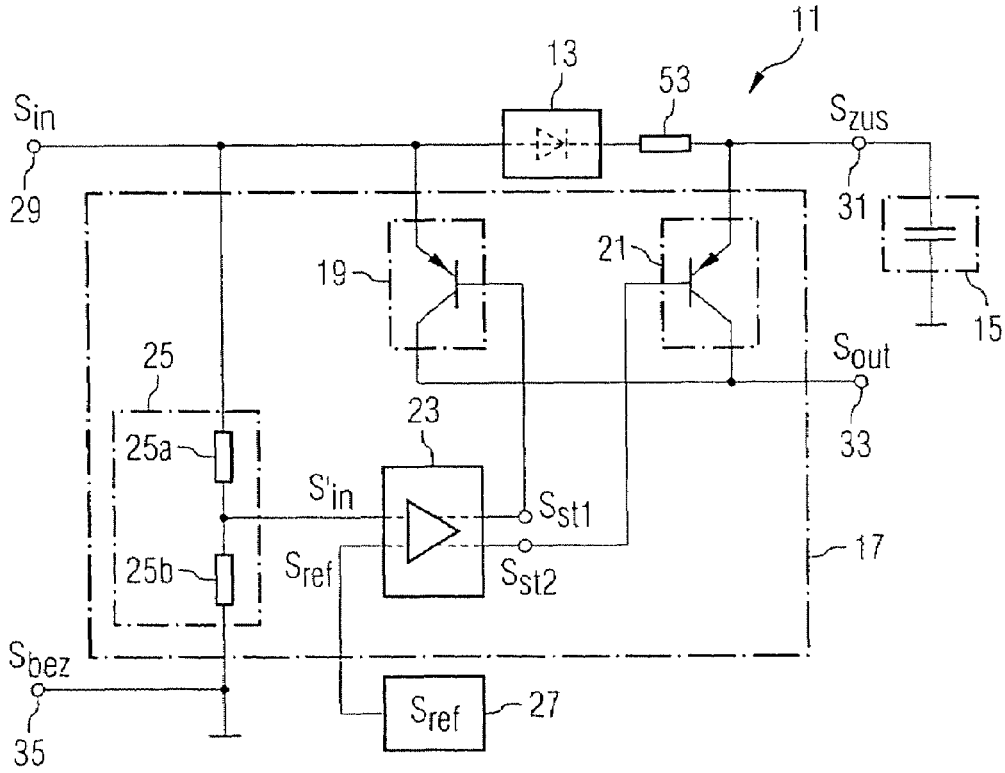

FIG. 1*b* illustrates schematically a possible technical realization of the power supply arrangement 11 illustrated in FIG. 1*a*.

As is illustrated in FIG. 1*b* with regard to the power supply arrangement 11, the charge means 13 has, for example, a diode circuit, wherein, for example, a rectifier diode or a bipolar transistor disposed in a diode circuit can be used. The charge storage means 15 is preferably implemented as capacitor arrangement. The switch-in control means 23 is for example implemented as comparison means and optionally as comparator means.

The reference signal $S_{ref}$ is, for example, provided by a bandgap circuit 27 as analog bandgap voltage, wherein the reference signal $S_{ref}$ can, for example, also be provided by a storage means as digital reference signal $S_{ref}$, which has information with regard to a threshold $S_{in\text{-}soll}$ with regard to the input signal $S_{in}$. In the embodiment illustrated in FIG. 1*b*, the input signal evaluation means 25 is illustrated as voltage divider of two resistor elements 25*a*, 25*b*, wherein the derived input signal $S'_{in}$ depends on the resistance ration of the resistor elements 25*a*, 25*b*.

In the simplest case, the input signal can be supplied directly to the switch-in control means 23, if the reference signal $S_{ref}$ is adapted for an evaluation by the comparison means 23. Based on an evaluation or comparison of the reference signal $R_{ref}$ with the derived input signal $S'_{in}$, the comparison means 23 provides the two control signals $S_{st1}$ and $S_{st2}$. The input signal switch-in means is, for example, implemented as first pnp bipolar transistor 19, while the supply signal switch-in means 21 is implemented as second pnp bipolar transistor, whose control terminals (base terminals) are each connected to the first control signal $S_{st1}$ or the second control signal $S_{st2}$, respectively. Now, the comparison means 23 generates the first and/or second control signal $S_{st1}$, $S_{st2}$, in dependence on the evaluation or comparison, respectively, of the reference signal with the derived input signal $S'_{in}$, so that the two bipolar transistors 19, 21 correspondingly either switch in the input signal $S_{in}$ and/or the additional supply signal $S_{zus}$ to the output signal $S_{out}$.

As has already been illustrated with regard to FIG. 1*a*, the comparison means 23 can be implemented as comparator means, wherein the first and second control signal $S_{st1}$ and $S_{st2}$ each can each have a low ("0") or a high ("1") logic complementary value, so that only the first bipolar transistor 19 or the second bipolar transistor 21 is conductive, respectively. The comparison means 23 can further be implemented to output intermediate values, so that the portion of the input signal $S_{in}$ and/or of the additional supply signal $S_{zus}$, which are supplied to the output signal terminal 33 via the two bipolar transistors 19, 21, and form the output signal $S_{out}$, can be adjusted with arbitrary intermediate stages or continuously, respectively, as has already been discussed functionally with regard to FIG. 1*a*.

With regard to the transistor means 19, 21 illustrated in FIG. 1*b*, it should further be considered that optionally polarity-inversion protection means can be inserted in the first or second signal path, respectively, and particularly polarity-inversion protection diodes, in order to avoid that a current flow results from the output terminal 33 to the input terminal 29 or the supplementary supply terminal 31, when the input signal level is set back too strongly.

Thus, the power supply arrangement of FIGS. 1*a* and 1*b* is implemented such that when required, i.e. when the input signal $S_{in}$ or the operating voltage, respectively, falls below a predetermined threshold $S_{in\text{-}soll}$ the supplementary supply signal $S_{zus}$ based on the first and second control signal $S_{st1}$, $S_{st2}$ provided by the supplementary control means 23 is at least partly switched in to the output signal $S_{out}$, wherein the supplementary supply signal $S_{zus}$ draws its energy from the charge storage means 15 in the form of a storage capacitor, which is charged to a higher level than the normal operating voltage.

Figure 3A:
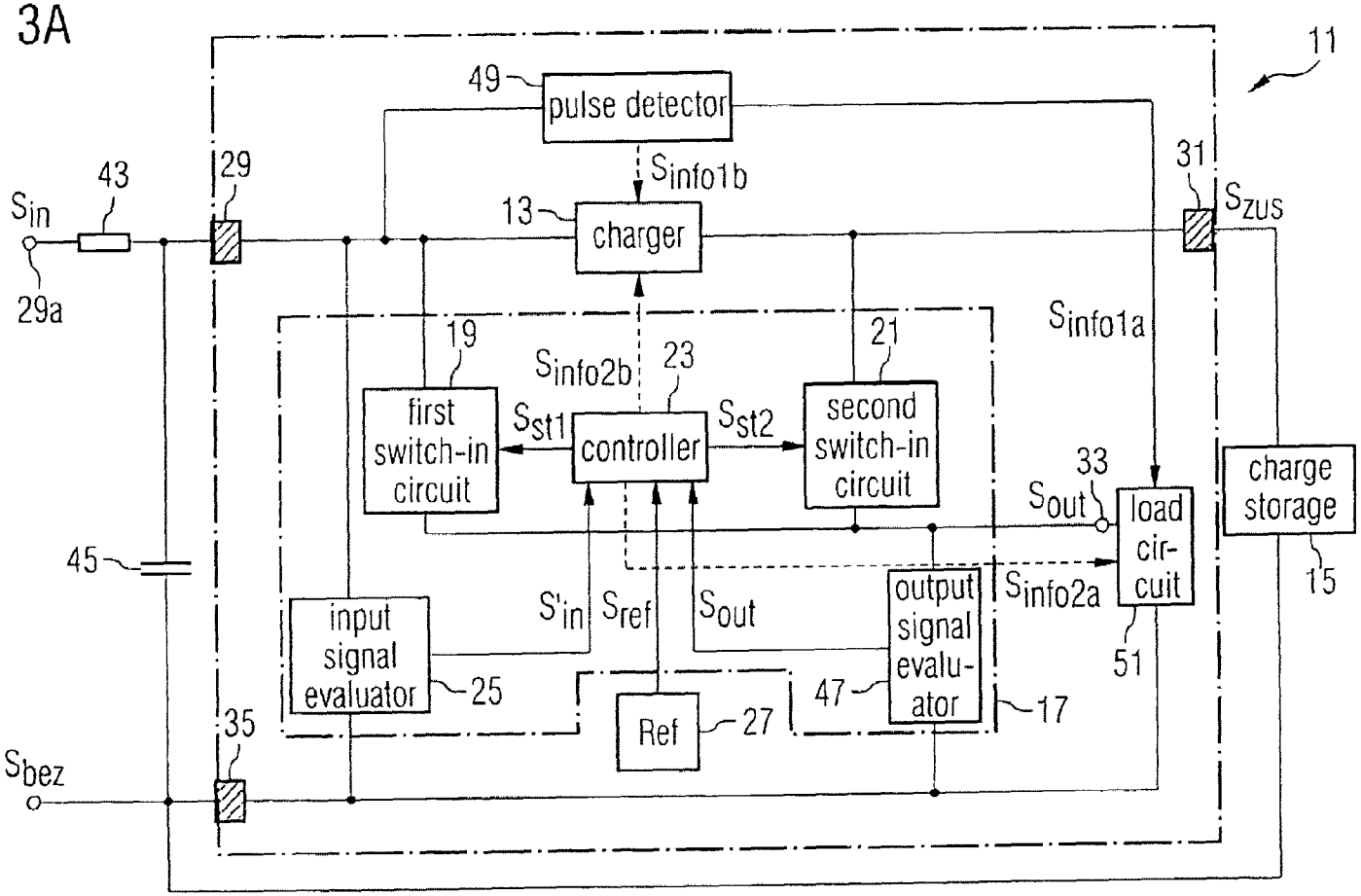
FIGS. 3*a-b* are a schematic illustration for discussing the mode of operation of a power supply arrangement according to a further embodiment and further a possible technical realization of the power supply arrangement according to the further embodiment.
Figure 3B:
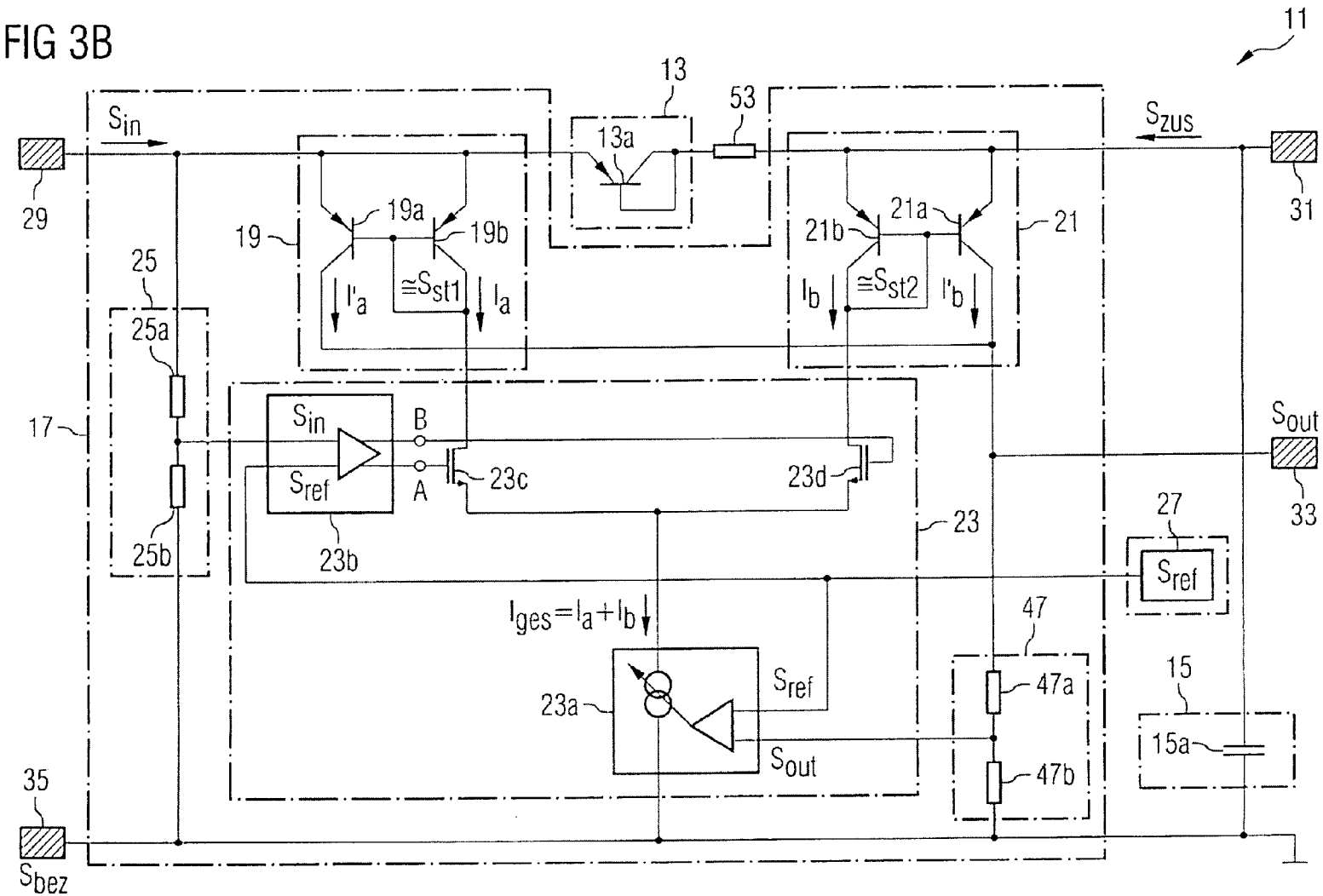

In the following, the basic mode of operation of a power supply arrangement 11 according to a further embodiment will be shown exemplarily with a schematic diagram with regard to FIG. 3*a*, wherein FIG. 3*b* shows a possible technical realization of the power supply arrangement 11 according to the further embodiment. With regard to the power supply arrangement illustrated in FIGS. 3*a* and 3*b* according to a further embodiment, it should be noted that the same is a development of the power supply arrangement illustrated in FIGS. 1*a* and 1*b*, so that similar or equal elements are designated by the same reference numbers in all figures, so that corresponding functional information can be used correspondingly in all figures.

In addition to the power supply arrangement according to the first embodiment shown in FIGS. 1*a*-1*b*, and the power supply arrangement 11 according to a further embodiment, optionally, an additional external terminal 29*a* and, on the input side, a resistor element 43, e.g. a EMC resistor (EMC=electromagnetic compatibility) and a filter capacitor 45 are arranged. Further, the processing means 17 has an output signal evaluation means, which is connected between the output terminal 33 for providing the output signal $S_{out}$ and the reference potential $S_{bez}$ (or a first and/or second reference potential, respectively) on the output side. Further, a pulse detection means 49 is provided at the input terminal 29. Further, a circuitry 51 (load circuit) to be supplied by the power supply arrangement 11 is illustrated in FIG. 3*a*.

In the following, the basic mode of operation of the development of the power supply arrangement 11 illustrated in FIG. 3*a* will be described.

As illustrated in FIG. 3*a*, the (optional) filter capacitor 45 is connected between the input terminal 29 and ground potential 35. Further, the optional input resistor 43 (EMC resistor) is connected between the input signal terminal 29 and the additional input signal terminal 29*a*. The filter capacitor 45 and the EMC resistor form an RC element on the input side, which serves to suppress high-frequency EMC interferences at the external input terminal 29*a* and to ease the detection of a pulse, e.g. a synchronization pulse 37 (compare FIG. 2) occurring in the input signal $S_{in}$ for the power supply arrangement 11. Thus, the RC element 43, 45 arranged on the input side can be considered as optional EMC protection circuit against voltage peaks resulting from EMC interferences.

As is further illustrated in FIG. 3*a*, the output signal evaluation means 47 is connected between the output terminal 33 and ground potential 35, and provides an output signal $S_{out}$ derived from the output signal $S_{out}$, which comprises information about the current signal level of the output signal $S_{out}$. The output signal evaluation means 47 provides the determined derived output signal $S'_{out}$ to the switch-in control means 23. It should be noted that the output signal evaluation means 41 shown basically in FIG. 3*a* can be implemented, for example, as voltage divider arrangement (as will be discussed in more detail below), wherein the output signal evaluation means 47 can further process the output signal $S_{out}$ in any analog or digital way, or can also pass it on directly to the switch-in control means 23 as derived output signal $S'_{out}$.

The pulse detection means 49 illustrated in FIG. 3*a* is preferably provided to detect the pulses, such as synchronization pulses, in the input signal $S_{in}$ or to determine, respectively, whether currently a pulse is present in the input signal $S_{in}$ or not, in order to provide a first and/or second information signal $S_{info1a}$, $S_{info1b}$ to the circuitry 51 (load circuit) to be supplied and/or the charge means 13, in dependence on whether a pulse is present in the input signal $S_{in}$ or not.

The first or second information signal $S_{info1a}$, $S_{info1b}$, provided by the pulse detection means 49 can, on the one hand, serve for allowing a synchronization, for example of the data transmission behavior of the circuitry 51 to be supplied with further circuitries (not shown in FIG. 3*a*), which can also detect the pulses occurring in the input signal $S_{in}$, or further for providing information to the charge means 13 that a synchronization pulse is present, which is preferably used for charging the charge storage means 15. Thus, when the input signal $S_{in}$ has the second input signal level $S_{in2}$ (see FIG. 2), i.e. a pulse is present in the input signal ($S_{in}$), this information signal $S_{info1b}$ can be used for closing a switch means when the charge means 13 is formed as switch means, such that the charge storage means 15 can be charged by the pulse, such as a synchronization pulse.

As has already been discussed with regard to FIG. 1*a*, the charge means is provided to have a conductive or non-conductive state for charging the charge storage means 15, in dependence on whether the signal level of the supplementary signal stored at the charge storage means 15 is higher or lower than the signal level of the input signal $S_{in}$. Thereby, the charge storage means can, for example, be implemented as a simple diode circuit, wherein circuitries can open or close, respectively, such a circuitry based on a comparison of the voltage levels at the input signal terminal 29 and the supply signal terminal 31.

If the charge means 30 is implemented as a circuitry (with a comparison means), the charge means 13 can further comprise a polarity-inversion protection means, so that the charge storage means 15 cannot be inadvertently discharged via an open circuitry.

The output signal $S'_{out}$ provided by the output signal evaluation means 47 depends on the signal level of the output signal $S_{out}$ or is derived therefrom, respectively. As illustrated in FIG. 3*a*, the switch-in control means 23 is implemented, to evaluate the derived output signal $S_{out}$ supplied by the output signal evaluation means 47, the reference signal $S_{ref}$ and/or the derived input signal $S'_{in}$ supplied by the input signal evaluation means 45, and to provide the first and second control signal $S_{st1}$ and $S_{st2}$ for controlling the input signal switch-in means 19 based on the evaluation of the signals $S'_{in}$, $S_{ref}$ and $S'_{out}$, to adjust switching in of the input signal $S_{in}$ and/or the additional supply signal $S_{zus}$ to the output signal $S_{out}$ corresponding to the evaluated input and output signal levels.

The evaluation of the derived input signal $S'_{in}$, the reference signal $S_{ref}$ and/or the derived output signal $S'_{out}$ can be performed, for example, by arbitrarily relating those signals, and for example by comparing the derived input signal $S'_{in}$ with the reference signal $S_{ref}$ and by comparing the derived output signal $S'_{out}$ with the reference signal $S_{ref}$. The aim of evaluating the provided signals $S'_{in}$, $S_{ref}$ and $S'_{out}$ is that always sufficient supply energy is provided at the output terminal 33, i.e. an output signal $S_{out}$ with a sufficiently high or predetermined output signal level, for the circuitry 51 to be supplied, even when so-called microbreaks occur in the input signal $S_{in}$.

It should be noted that also the input signal and/or the supply signal switch-in means 19, 21 can have so-called polarity-inversion protection means, for example in the form of polarity-inversion protection diodes, in order to avoid an inadvertent load of the output signal $S_{out}$.

Based on the evaluation of the supplied signals $S'_{in}$, $S_{ref}$ and $S_{out}$ to be evaluated performed by the switch-in control means 23, the switch-in control means 23 determines whether the input signal $S_{in}$ (the external operating voltage) is sufficient to provide the output signal $S_{out}$ at the output signal terminal 33 for the downstream circuitry 51 to be supplied. When the input signal $S_{in}$ has a level which is higher in amount than the allowable threshold $S_{in\text{-}soll}$, the power supply arrangement 11 can provide the input signal $S_{in}$ or a signal derived therefrom via the input signal switch-in arrangement 90 at the output terminal 33 as output signal $S_{out}$ for the downstream circuitry 51 to be supplied. When the level of the input signal $S_{in}$, for example due to so-called microbreaks, falls in amount below the allowable threshold $S_{in\text{-}soll}$, and the switch-in control means 23 detects this state, according to an embodiment, the supply signal switch-in means 21 is controlled via the second control signal $S_{st2}$ of the switch-in control means 23 to at least partly switch in the additional supply signal $S_{zus}$ provided by the charge storage means 15 to the output signal $S_{out}$. Thus, when required, the output signal $S_{out}$ is fed at least partly by the charge storage means 15 implemented as storage capacitor. The proportion to what extent the input signal $S_{in}$ and/or the additional supply signal $S_{zus}$ contribute to the output signal $S_{out}$, is obtained by the switch-in control means 23 due to the evaluation of the supplied signals $S'_{in}$, $S_{ref}$ and/or $S'_{out}$ to be evaluated, and via the control signals $S_{st1}$ and $S_{st2}$ provided to the input signal switch-in means 19 and the supply signal switch-in means 21.

As further illustrated in FIG. 3*a*, the switch-in control means can optionally supply further information signals $S_{info2a}$, $S_{info2b}$ to the charge means 13 and/or also to the downstream circuitry 51 to be supplied. The information signal $S_{info2a}$ supplied to the circuitry 51 to be supplied can, for example, serve to indicate to the circuitry 51 to be supplied that the same should, if possible, reduce its current consumption when the level of the input signal $S_{in}$ falls below the allowable threshold $S_{in\text{-}soll}$. On receiving the information signal $S_{info2a}$, the downstream circuitry 51 to be supplied can, for example, turn off currently unnecessary current consumers. Such a current consumer could be, for example, a current modulator in a side airbag sensor. Such a current modulator serves to perform data transmission, for example to an electronic control unit, and has thereby frequently a higher current consumption than the side airbag sensor itself. Thereby, with regard to the possible switching off of such a current modulator, it should be considered that during a microbreak, when the connection between the side airbag sensor and the electronic control unit is interrupted, an exchange of data or information, respectively, between the electronic control unit and the side airbag sensor is substantially impossible anyway, since the level of the input signal $S_{in}$ has fallen below the allowable threshold $S_{in\text{-}soll}$.

The information signal $S_{info1b}$ provided by the switch-in control means 22 can, for example, inform the charge means 13, that a so-called microbreak is present, so that the charge means, when the same is, for example, implemented as switch arrangement, can close this switch arrangement immediately to avoid inadvertent discharge of the charge storage means 15. Further, the information signal $S_{info2b}$ provided by the switch-in control means 23 can be used to indicate to a charge means optionally formed as a switch arrangement, that the electric connection between the input terminal 29 and the supplementary supply terminal 31 is explicitly opened or closed, respectively, in order to disconnect the first and second signal path formed by the input signal switch-in means 19 and the supply signal switch-in means 21 on the input side when opening the switch arrangement of the charge means 13.

In the following, based on FIG. 3*b*, a possible technical realization of the functional arrangement of the power supply arrangement basically illustrated in FIG. 3*a* will be discussed.

With regard to FIG. 3*b*, it should also be noted that again elements having the same or similar function illustrated in FIGS. 1*a-b* 2 and 3*a-b* are designated with the same reference numbers, and thus their description is applicable as well.

In the following, based on the functional blocks illustrated in FIG. 3*a*, their exemplary technical realization is illustrated in FIG. 3*b*.

As illustrated in FIG. 3*b*, the charge means 13 is, for example, implemented as a bipolar transistor 13*a* arranged in diode circuit. Further, optionally, the charge means 13 has a limiting resistor element 53. The charge storage means 15 is implemented as storage capacitor 15*a*. The input signal switch-in means 19 is implemented as current mirror circuit with a first PNP bipolar transistor 19*a* and a second PNP bipolar transistor 19*b*. On the input side, the first current mirror circuit 19 is connected to the input signal terminal 29, wherein the output terminal (collector terminal) of the PNP bipolar transistor 19*a* is electrically connected to the output terminal 33 and the output terminal (collector terminal) of the PNP bipolar transistor 19*b* forms the control terminal of the current mirror circuit 19, i.e. the input signal switch-in means 19.

The supply signal switch-in means 21 is further implemented as current mirror circuit with a third PNP bipolar transistor 21*a* and a fourth PNP bipolar transistor 21*b*. The two bipolar transistors 21*a*, 21*b* are connected to the supplementary supply signal terminal 31 with their input terminals (emitter terminals), while the output terminal (collector terminal) of the third PNP bipolar transistor 21*a* is electrically coupled to the output terminal 33, and wherein the output terminal (collector terminal) of the fourth PNP bipolar transistor 21*b* forms the control input of the supply signal switch-in means 21.

In FIG. 3*b*, the switch-in control means 23 has a current control means 23*a*, a comparison means 23*b*, a first nMOS field-effect transistor 23*c*, and a second nMOS field-effect transistor 23*d*. As illustrated in FIG. 3*b*, the current control means 23*a* has first and second input terminals for receiving the reference signals $S_{ref}$ and the derived output signal $S'_{out}$. The reference signal $S_{ref}$ is provided by the reference signal source 27, which is, for example, implemented as bandgap circuit. The derived output signal $S'_{out}$ is, for example, obtained from a center tap of the output signal evaluation means 47 implemented as voltage divider, with first and second resistor elements 47*a* and 47*b*, which are connected in series between the output signal terminal 33 and the ground terminal 35. The current control means 23*a* is further implemented to provide a controlled total current $I_{ges}$ referenced to ground potential based on an evaluation of the derived output signal $S'_{out}$ and the reference signal $S_{ref}$, so that the current control means 23*a* is, for example, effective as controlled current source.

The comparison means 23*b* is implemented to evaluate the derived input signal $S'_{in}$ with the reference signal $S_{ref}$, and to compare them, for example, and to provide first and second output signals A, B based on the evaluation of the signals $S'_{in}$ and $S_{ref}$. In the example illustrated in FIG. 3*b*, the reference signal $S_{ref}$ of the comparison means 23*b* is also provided by the reference signal source 27. The derived input signal $S'_{in}$ is provided by the input signal evaluation means 25 implemented as voltage divider with the resistor elements 25*a*, 25*b* at their center tap. In the simplest case, the output signals A, B provided by the comparison means are logic signals with complementary logic signal levels ("0", "1"). The output signals A, B output by the comparison means 23*b* can have any intermediate values, as will become clear below.

The control terminal (gate terminal) of the first nMOS field-effect transistor 23*c* is connected to the first output terminal for providing the output signal A of the comparison means 23*b*. The input terminal (drain terminal) of the first nMOS field-effect transistor 23*c* is connected to the control terminal of the input signal switch-in means 19, i.e. with the collector terminal of the second PNP bipolar transistor 19*d*. The output terminal (source terminal) of the first nMOS field-effect transistor 23*c* is connected to the terminal for providing the total current $I_{ges}$ of the current control means 23*a*.

The control terminal (gate terminal) of the second nMOS field-effect transistor 23*d* is connected to the second output terminal of the comparison means 23*b* for providing the second output signal B. The input terminal (drain terminal) of the second nMOS field-effect transistor 23*d* is connected to the control terminal of the supply signal switch-in means 21, i.e. to the collector terminal of the fourth PNP bipolar transistor 21*b*, wherein the output terminal (source terminal) of the second nMOS field-effect transistor 23*d* is further connected to the current provision terminal for providing the total current $I_{ges}$ of the current control means 23*a*.

The reference signal source 27 illustrated in FIG. 3*b* is implemented, for example, as a so-called bandgap circuit, which, for example, provides a bandgap voltage of 1.25 Volt. For that reason, the resistor elements 25*a*, 25*b* and 47*a*, 47*b* of the input signal evaluation means 25 or the output signal evaluation means 47, respectively, are implemented to divide down the respective input signal level $S_{in}$ or the output signal level $S_{out}$ down to a derived value $S'_{in}$, $S'_{out}$, so that the same can be evaluated and preferably compared with the reference signal $S_{ref}$ of the reference signal source 27. However, according to an embodiment, it should be noted that the provided bandgap voltage can also be amplified to a higher value, so that no voltage divider arrangements are required, and the levels of the input signal $S_{in}$ or the output signal $S_{out}$, respectively, can be supplied directly to the current control means 23*a* or comparison means 23*b*, respectively.

Further, it should be noted that the reference signal $S_{ref}$ can be present, for example, either in analog or also digital form, wherein the reference signal source can also be implemented, for example, as logic storage means for providing a logic storage value, which represents the reference signal $S_{ref}$. The reference signal source 27 only has to be implemented to allow an evaluation of the input signal $S_{in}$ or the output signal $S_{out}$ or their derived signals $S'_{in}$, $S'_{out}$, respectively.

Below, the mode of operation of the realization of the power supply arrangement 11 illustrated in FIG. 3 will be discussed.

As illustrated in FIG. 3*b*, the charge means 13 has a diode circuit 13*a*, with a current limiting resistor 53.

For the case that the storage capacitor 15*a* is at least partly or fully discharged, the current limiting resistor 53 is provided to ensure that in a charge process no too high charge current flows to the storage capacitor 15*a*, which could, in an extreme case, represent an extremely high load, such as a short-term short circuit, so that the input signal $S_{in}$ is not too heavily loaded.

If the input signal $S_{in}$ has a higher level than the additional supply signal $S_{zus}$ at the supply signal terminal 31, for example when a synchronization pulse 37 (compare FIG. 2) is overlaying the operating voltage, the capacitor 15*a* can be charged to a higher supply signal level $S_{zus}$.

If, for example, the level of the input signal $S_{in}$ sinks below a predetermined threshold, which is, for example, represented by the reference signal $S_{ref}$, the comparison means 23*b* will detect this and controls correspondingly its output signals A, B, so that the first and second nMOS field-effect transistor are correspondingly controlled at their control terminals (gate terminals). Thus, the control signal A and the control signal B allow an adjustment, which portion $I_a$ of the total current $I_{ges}$ flows through the first nMOS field-effect transistor 23*c*, and which portion $I_b$ of the total current $I_{ges}$ flows through the second field-effect transistor, wherein the sum of the two partial currents $I_a$, $I_b$, results in the total current $I_{ges}$. Since the current control means 23*a* of the power supply arrangement 11 is implemented as controllable current source, the total current $I_{ges}$ can be adjusted by an evaluation of the derived output signal $S'_{out}$ with the reference signal $S_{ref}$. Thereby, the current control means 23*a* can react to a load of the output signal at the output terminal 33, for example by the downstream circuitry 51 to be supplied, since the output signal level of the output signal $S_{out}$ falls with increased load, and this falling is detected by the current control means 23*a* and, as a response, the total current $I_{ges}$ is increased.

With a change of the total current $I_{ges}$, the respective value of the first and second current portions $I_a$ and $I_b$ is changed, wherein the two portions $I_a$, $I_b$, as already represented above, are adjusted by the output signals A, B of the comparison means 23*b* via the first and second nMOS field-effect transistor 23*c*, 23*d*. As can be seen from FIG. 3*b*, the current portion $I_a$ (corresponds to the first control signal $S_{st1}$) is impressed into the second bipolar transistor 19*b*, and mirrored in the first PNP bipolar transistor 19*a* with a predetermined current mirror ratio α, whereby the mirrored current portion $I'_a$ ($I'_a=\alpha*I_a$, with α=current mirror factor) is obtained, which contributes to the output signal $S_{out}$. Correspondingly, the current portion $I_b$ (corresponds to the second control signal $S_{st2}$) is impressed into the fourth PNP bipolar transistor, wherein corresponding to a second predetermined current mirror ratio β, the mirrored output current of the third PNP bipolar transistor 21*a* is obtained (with $I'_b=\beta*I_d$, with β=second current mirror factor).

Further, the second mirrored current portion $I'_b$ contributes the output signal $S_{out}$, which is provided at the output signal terminal 32. Thus, the total energy of the output signal $S_{out}$ at the output terminal 33 is adjusted via the current control means 23*a*, wherein the comparison means 23*b* controls via their output signals A, B, by which ratio the input signal $S_e$ and/or the digital supply signal $S_{zus}$ contribute to the output signal $S_{out}$.

With regard to the input signal switch-in means 19 or the supply signal switch-in means 21, which are, for example, implemented as current mirror circuits in the realization illustrated in FIG. 3*b*, it should be noted that the current mirror circuits can each have so-called polarity-inversion protection means, such as polarity-inversion protection diodes, to prevent current flow from the output terminal 33 in direction of the input terminal 29 or the supplementary supply terminal 31, if the same are on a lower potential than the output signal terminal 33.

With regard to the circuitry illustrated in FIG. 3*b*, it should be noted that a reference potential $S_{bez}$ is illustrated, which forms, for example, ground potential, wherein it should be noted with regard to the present power supply arrangement 11 that different circuitries can possibly be referenced to different reference potentials.

With regard to charging the storage capacitor 15*a*, it should be noted, that the same is optimally performed theoretically to the signal level of the input signal $S_{in}$ during the pulse 37 (synchronization pulse), wherein, however, in practice, the signal level of the supplementary supply signal $S_{zus}$ is slightly below (0.7 V) the second input signal level $S_{in2}$, but above the first input signal level $S_{in1}$, for example due to the voltage drop across the diode 13*a* in forward bias.

As has already been noted above, the ratio of the current portions $I_a$, $I_b$ of the total current $I_{ges}$ is adjusted by the nMOS field-effect transistors 23*c*, 23*d* or via their control with the control signal A, B, respectively. If, for example, the two nMOS field-effect transistors 23*c*, 23*d* have a lower steepness of their characteristic curve, which represents the drain source current versus the gate source voltage, continuous cross-fading of the current portions $I_a$ and $I_b$ and thus the resulting mirrored current portions $I'_a$ and $I'_b$ for providing the output signal $S_{out}$ can be adjusted. Thereby, the control signals A, B have preferably a continuous curve.

However, it can also be desired that merely one of the mirrored current portions $I'_a$ or $I'_b$ contributes to the output signal $S_{out}$, wherein therefore, for example, the two nMOS field-effect transistors 23*c*, 23*d* are formed with high steepness, and preferably the control signals A, B indicate complementary logic signal states, so that the two nMOS field-effect transistors have merely two specific switching states "on/off". Thereby, it can be ensured that the output signal $S_{out}$ is exclusively fed either from the input signal $S_{in}$ or the supplementary supply signal $S_{zus}$, wherein the non-required signal paths are then completely switched off. This means that one can strictly switch between the signal paths formed by the input signal switch-in means 19 and the supply signal switch-in means 21, respectively.

Thus, the power supply arrangement allows that the output signal $S_{out}$ is provided with the predetermined output signal level for a downstream circuitry 51 to be supplied, e.g. an airbag sensor and particularly a side airbag sensor at the output signal terminal 33.

In the following, the principle of the power supply arrangement 11 will be illustrated again in summary.

The protocols, which are, for example, used for side airbag sensors, use, for example, the current consumption of a sensor arrangement to transmit signals from the sensor arrangement to an electronic control unit (ECU). Many protocols, such as proprietary protocols of sensor producers, use additionally the operating voltage to transmit a synchronization pulse to the sensor arrangement, which allows to determine the measurement time for the following measurement, and to synchronize the transmission of measurement data, such as pressure and acceleration, via a so-called "minibus", where the two or more sensor arrangements are on one line, within a defined sequence of time slots. This synchronization pulse is generated by increasing the operating voltage or the input signal $S_{in}$ from a first input signal level $S_{in1}$ to a second input signal level $S_{in2}$ with a level increased in amount. If this regularly transmitted synchronization pulse 37 (compare FIG. 2) is used for charging the storage capacitor 15, sufficient supply voltage is available via the storage capacitor 15, even when the sensor arrangement is already at its lowest operating voltage limit (which means closely above the reset threshold) of the side airbag sensor, which allows to delay or to avoid, respectively, an undesired reset process by operating the sensor arrangement, i.e. the circuitry 51 to be supplied downstream of the charge supply arrangement 11, from the storage capacitor 15.

According to the power supply arrangement 11, the synchronization pulse 37 for charging the charge storage means 15 is connected to the storage capacitor via the charging means 13. In the simplest case, the charge circuit can be a rectifier diode but can also be a circuitry, such as a switch arrangement, which is controlled by the synchronization pulse detector (pulse detection means) 49 and reduces the voltage drop across the charging means 13 by actively controlling a switch arrangement 13*a*. Further, the charge means 13 can include a polarity-inversion protection. Further, the connection between the input signal terminal 29 and the supplementary supply signal terminal 33 can be optionally actively prevented by the circuitry, when the processing means 17 generates the supply of the downstream circuitry 51 to be supplied from the storage capacitor 15. The storage capacitor for storing the energy is normally implemented as device external to the supply voltage arrangement, which is, for example, implemented as integrated semiconductor circuit, which is connected to the power supply arrangement 11 via a further pad. Typical capacitances of storage capacitors, as they can be used in an embodiment, are in a range of preferably 100 nF.

The processing means 17 consists substantially of three main elements, two of which are in the lines of the two alternative supply signals (input signal, supplementary supply signal) $S_{in}$ and $S_{zus}$ to the regulated supply voltage $S_{out}$. As has been discussed above, the same are, in the minimum case, the regulating transistors 19, 21 (see FIG. 1*a*), wherein, however, the polarity-inversion protection diodes can also be included. Further, parts of the switch-in control means 23, i.e. parts of the control arrangements of the regulating transistors 19, 21, such as the level shifter, can be included, or switch arrangements can be included, which specifically turn the non-active branch, i.e. either the input signal switch-in means 19 or the supply signal switch-in means 21, on or off. In the maximum case, different regulation characteristics can be obtained for both branches, i.e. input signal switch-in means 19 and the supply signal switch-in means 21, by individual "regulating amplifiers".

The third portion of the processing means 17, i.e. the switch-in control means 23, serves preferably both longitudinal branches, i.e. both input signal switch-in means 19 and the supply signal switch-in means 21 via the control signals $S_{st1}$, $S_{st2}$, wherein the required regulating amplifier 23*a*-23*d* is preferably included in this portion of the processing means 17, to be able to use as little hardware as possible, in order to limit both the power consumption and the effort for the power supply arrangement 11 to be realized according to an embodiment.

The switch-in control means 23 receives a so-called feedback signal $S'_{out}$, which is derived from the regulated output voltage $S_{out}$ and is set to a reference value $S_{ref}$ for regulation, or is evaluated or compared to the same, respectively. Above that, the third regulator block, i.e. the switch-in control means 23, contains a further feedback signal $S'_{in}$, which is derived from the available external operating voltage $S_{in}$ (input signal) and serves as criterion whether the external operating voltage $S_{in}$ is sufficient to generate the internal regulated output voltage $S_{out}$ with the predetermined signal level, compared to the reference signal $S_{ref}$ and the regulated output signal $S_{out}$ with the predetermined output signal level.

If this is the case, the power supply arrangement 11 can provide the output signal $S_{out}$ with only one longitudinal branch from the input signal $S_{in}$. If this is not the case, according to an embodiment, the second longitudinal branch, i.e. the supply signal switch-in means 21, is activated, so that the energy stored in the storage capacitor 15 can be used, wherein this activation of the second longitudinal branch 21 can be performed in the simplest case by switching from the first longitudinal branch 19 to the second longitudinal branch 21.

As has further been discussed above in detail, instead of abruptly switching the circuit branches formed by the input signal switch-in means 19 and the supply signal switch-in means 21, continuous or for every circuit branch 19, 21 predetermined, cross-fading can be preformed, to use the external operating voltage $S_{in}$ for so long as the same can provide a contribution (not sufficient on its own) for providing the output signal $S_{out}$ for the downstream circuitry 51 to be supplied.

Additionally, during switching or cross-fading between the signal paths 19, 21, respectively, an information signal $S_{info2a}$ can be output to the circuitry 51 to be supplied, which serves to indicate to the circuitry 51 to be supplied, to turn off unnecessary consumers in this state (of switching-in the supply voltage signal $S_{zus}$). In this context, particularly, a current modulator of a downstream side airbag sensor 51 to be supplied has to be mentioned, which frequently uses more energy for realizing the data transmission from an electronic control unit (ECU), than the side airbag sensor itself requires. Since the connection of the side airbag sensor to the electronic control unit ECU is disconnected in the case of a microbreak in the input signal $S_{in}$, transmitting data from the side airbag sensor to the electronic control unit in this state is not possible anyway, so that the current modulator can preferably be switched off.

The power supply arrangement 11 discussed above in detail uses PNP low drop architecture in the technical realizations illustrated with regard to FIGS. 1*a*-*b*, 2 and 3*a*-*b*. The current portions $I'_a$ and $I'_b$ through the bipolar regulator transistors 19*a* and 21*a* are controlled via current mirror circuits, i.e. respectively associated current mirror bipolar transistors 19*b* and 21*b*. The control total current $I_{ges}$ is thereby provided from a regulator 23*a* with current output, i.e. the current control means 23*a*. The distribution of the regulation current portions $I'_a$, $I'_b$ on the two regulator branches formed by the input signal switch-in means 19 and the supply signal switch-in means 21 is performed via the nMOS field-effect transistors 23*c* and 23*d*. If only field-effect transistors with lower steepness or a control circuit (comparison means 23*b* ) with lower amplification are selected, continuous or arbitrarily set cross-fading between the first and second signal path 19, 21 can be obtained. If, however, field-effect transistors with large steepness and a comparison means 23*b*, which is, for example, implemented as comparator means, are selected, the nMOS field-effect transistors are operated as circuitries, wherein switching between the two signal paths 19, 21 is made abruptly, as soon as the provided derived input signal $S'_{in}$ is, for example, lower than the provided reference signal $S_{ref}$.

The above discussions with regard to the power supply arrangements 11 illustrated in the figures illustrate that the embodiments have a number of advantages compared with conventional power supply arrangements in which buffer capacitors are common, which stabilize the operating input voltage of a sensor. However, those conventional buffer capacitors are only charged to the current operating voltage. When the operating voltage is at the specified bottom limit, which means only slightly above the reset threshold, only little charge can be taken from the buffer capacitors, until reset is triggered. This is prevented by the power supply arrangement according to the embodiments, since the supplementary capacitor 15*a* is charged to a supplementary supply signal $S_{zus}$, which has a level above the input signal level $S_{in}$.

Above that, it should be noted that in conventional arrangements, the sizes of the buffer capacitors are limited, which results from the time constant of the RC element of buffer capacitors and EMV protection resistor. The time constant has to be short enough for not filtering out the synchronization pulse (see FIG. 2). In order to avoid this problem, according to conventional arrangements, a second external RC element would need to be used, which protects the signal path for the synchronization signal with a filter constant parallel to the operating voltage against EMV influences, and supplies the synchronization signal filtered in that way to a separate input terminal pin of the sensor arrangement. The additional external resistor and capacitor for the second external RC element would, of course, represent a cost disadvantage due to the additional effort in terms of circuit technology. Above that, it should be noted that capacitors become significantly more expensive when their sizes exceed approximately 100 nF, so that such an implementation would have to be realized with relatively high cost.

The power supply arrangement 11 illustrated above in detail can limit exactly those above-described limitations, as they are predetermined by the conventional power supply arrangement, as has been discussed above in detail.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. A power supply arrangement with an input terminal for receiving an input signal with an actual input signal level and an output terminal for providing an output signal with a predetermined output signal level, comprising:

a charge storage, which is implemented to store electrical energy, and to provide a supplementary supply signal with a supplementary supply signal level;

a charger, which is implemented to receive the input signal, wherein the input signal assumes a first input signal level and a second input signal level successively in time, wherein the second input signal level is higher in amount than the first input signal level and has the form of pulses overlaying the first input signal level, and which is further implemented to couple the charge storage to the input signal, when the actual input signal level is on a higher level in amount than the supplementary supply signal level, and otherwise to decouple the charge storage from the input signal;

a reference signal source, which is implemented to provide a reference signal comprising information about a set input signal level; and a processor, which is formed to provide the output signal with the predetermined output signal level at the output terminal, based on the supplementary supply signal or based on a combination of the supplementary supply signal and the input signal, if the actual input signal level is lower in amount than the set input signal level.

2. The power supply arrangement according to claim 1, wherein the charger is further implemented to charge the charge storage to the supplementary supply signal level, when the input signal is on the second input signal level, wherein the supplementary supply signal level is higher in amount than the first input signal level, when the charge storage is in the charged state.

3. The power supply arrangement according to claim 1, wherein the processor comprises a controller and a supply signal switch-in element, wherein the supply signal switch-in element is connected between the charge storage and the output terminal of the power supply arrangement, and wherein the controller is implemented to evaluate a signal depending on the input signal based on the reference signal, and to control the supply signal switch-in element with a control signal based on the evaluation, such that the output signal has the predetermined output signal level, and wherein the supply signal switch-in element is implemented to switch in the supplementary supply signal at least partly to the output signal based on the control signal, when the actual input signal level is lower in amount than the set input signal level.

4. The power supply arrangement according to claim 3, wherein the supply signal switch-in element has a switch arrangement, which is connected between the output terminal and the charge storage.

5. The power supply arrangement according to claim 3, wherein the switch-in controller is implemented to set the supply signal switch-in element, such when the actual input signal level is lower in amount than the set input signal level, the output signal is based on the combination of the supplementary supply signal and the input signal.

6. The power supply arrangement according to claim 3, wherein the switch-in controller is implemented to control the supply signal switch-in element such that the supply signal switch-in element increases the portion of the supplementary supply signal of the output signal with an increasing difference in amount between the actual input signal level and the set input signal level, and reduces the same with a decreasing difference in amount between the actual input signal level and the set input signal level, when the actual input signal level is smaller in amount than the set input signal level.

7. The power supply arrangement according to claim 3, wherein the switch-in controller is implemented to adjust the supply signal switch-in element such that the portion of the surpplementary supply signal of the output signal is proportional to a difference in amount between the actual input signal level and the set input signal level, when the actual input signal level is lower in amount than the set input signal level.

8. The power supply arrangement according to claim 3, wherein the supply signal switch-in element has a resistor alterable by the control signal, which is connected between the charge storage and the output terminal.

9. The power supply arrangement according to claim 3, wherein the supply signal switch-in element has a switch-in transistor, which is controllable by the control signal.

10. The power supply arrangement according to claim 3, wherein the supply signal switch-in element has a current mirror circuit with an input terminal, an output terminal and a mirrored output terminal, wherein the input terminal is connected to the supplementary supply signal, the output terminal is connected to the processor, and the mirrored output terminal is connected to the output signal.

11. The power supply arrangement according to claim 3, wherein the processor has an input signal switch-in element, wherein the input signal switch-in element is connected between the input terminal and the output terminal, wherein the input signal switch-in element is controllable by a further control signal of the switch-in element, to switch in the input signal at least partly to the output signal, wherein the second control signal is based on an evaluation of the derived input signal and the reference signal.

12. The power supply arrangement according to claim 11, wherein the input signal switch-in element has a switch arrangement, which is connected between the input terminal and the output terminal and is controllable by the further control signal.

13. The power supply arrangement according to claim 12, wherein the input signal switch-in element has a second resistor alterable by the further control signal, which is connected between the input terminal and the output terminal.

14. The power supply arrangement according to claim 12, wherein the input signal switch-in element has a switch-in transistor arrangement, which is controllable by the further control signal.

15. The power supply arrangement according to claim 14, wherein the input signal switch-in element has a second current mirror circuit with an input terminal, an output terminal and a mirrored output terminal, wherein the input terminal is connected to the input signal, the output terminal is connected to the processor and the mirrored output terminal is connected to the output signal.

16. The power supply arrangement according to claim 12, wherein the switch-in controller is implemented to evaluate a signal depending on the output signal based on the reference signal, and to control the supply signal switch-in element and the input signal switch-in element based on the evaluation such that the output signal has the predetermined output signal level.

17. The power supply arrangement according to claim 11, wherein the switch-in controller is implemented to adjust the input signal switch-in element such that the output signal is based on the combination of the supplementary supply signal and the input signal, and the input signal switch-in element reduces a portion of the input signal of the output signal with an increasing difference in amount between the actual input signal level and the set input signal level, and increases the same with a decreasing difference in amount between the actual input signal level and the set input signal level, when the actual input signal level is lower in amount than the set input signal level.

18. The power supply arrangement according to claim 17, wherein the switch-in controller is implemented to adjust the input signal switch-in element such that the input signal switch-in element adjusts a portion of the input signal of the output signal in a linear dependence on a difference in amount between the actual input signal level and the set input signal level, when the actual input signal level is lower in amount than the set input signal level.

19. The power supply arrangement according to claim 11, wherein the switch-in controller is implemented to control the supply signal switch-in element and the input signal switch-in element such that the output signal is based on a combination of the supplementary supply signal and the input signal, and wherein the switch-in controller is further implemented to continuously cross-fade between the supplementary supply signal and the input signal based on a difference between the actual input signal level and the set input signal level when the actual input signal level is below the set input signal level.

20. The power supply arrangement according to claim 1, wherein the processor is implemented to provide an information signal when the actual input signal level is lower in amount than the set input signal level.

21. The power supply arrangement according to claim 1, wherein the charger is implemented as diode circuit.

22. The power supply arrangement according claim 1, wherein the charger is implemented to compare the supplementary supply signal level to the input signal level, and to charge the charge storage when the supplementary supply level is lower in amount than the actual input signal level.

23. The power supply arrangement according to claim 1, wherein the charger and the processor are integrated on a semiconductor circuit substrate.

24. The power supply arrangement according to claim 23, wherein the charge storage is arranged as storage capacitor external to the semiconductor circuit substrate.

25. The power supply arrangement according to claim 23, wherein the storage capacitor is integrated on the semiconductor circuit substrate with the charger and the processor.

26. The power supply arrangement according to claim 1, wherein the input signal has a first input signal level with a voltage value of 5 Volt to 18 Volt, and a second input signal level with a voltage value of 9 Volt to 24 Volt.

27. The power supply arrangement according to claim 1, wherein the second input signal level has a pulse width of 30 to 80 μs and a period duration of 230 μs to 600 μs.

28. The power supply arrangement according to claim 1, wherein the pulses overlaying the first input signal level are periodic pulses.

29. The power supply arrangement according to claim 28, wherein the periodic pulses are synchronization pulses to a side airbag sensor.

30. The power supply arrangement according to claim 1, further comprising a pulse detector, wherein the pulse detector is implemented to determine the presence of a pulse in the input signal.

31. The power supply arrangement according to claim 30, wherein the pulse detector is implemented to provide an information signal indicating the presence of a pulse overlaying the first input level to the charger.

32. A side airbag sensor system comprising a power supply arrangement with an input terminal for receiving an input signal with an actual input signal level and an output terminal for providing an output signal with a predetermined output signal level, comprising:

a charge storage, which is implemented to store electrical energy, and to provide a supplementary supply signal with a supplementary supply signal level;

a charger, which is implemented to receive the input signal, wherein the input signal assumes a first input signal level and a second input signal level successively in time, wherein the second input signal level is higher in amount than the first input signal level and has the form of pulses overlaying the first input signal level, and which is further implemented to couple the charge storage to the input signal, when the actual input signal level is on a higher level in amount than the supplementary supply signal level, and otherwise to decouple the charge storage from the input signal;

a reference signal source, which is implemented to provide a reference signal comprising information about a set input signal level; and a processor, which is formed to provide the output signal with the predetermined output signal level at the output terminal, based on the supplementary supply signal or based on a combination of the supplementary supply signal and the input signal, if the actual input signal level is lower in amount than the set input signal level.

33. A power supply arrangement with an input terminal for receiving an input signal with an actual input signal level and an output terminal for providing an output signal with a predetermined output signal level, comprising:

a charge storage, which is implemented to store electrical energy, and to provide a supplementary supply signal with a supplementary supply signal level;

a charger, which is implemented to receive the input signal, wherein the input signal assumes a first input signal level and a second input signal level successively in time, wherein the second input signal level is higher in amount than the first input signal level and has the form of pulses overlaying the first input signal level, and which is further implemented to couple the charge storage to the input signal, when the actual input signal level is on a higher level in amount than the supplementary supply signal level, and otherwise to decouple the charge storage from the input signal;

a reference signal source, which is implemented to provide a reference signal comprising information about a set input signal level; and a processor, which is formed to provide the output signal with the predetermined output signal level at the output terminal, based on a combination of the supplementary supply signal and the input signal, if the actual input signal level is lower in amount than the set input signal level.

* * * * *